US007278185B2

(12) United States Patent
Smith

(10) Patent No.: US 7,278,185 B2
(45) Date of Patent: Oct. 9, 2007

(54) RESTRICTING DEVICE

(75) Inventor: Mathew John Smith, Cheltenham (GB)

(73) Assignee: SecuriStyle Limited (GB)

( * ) Notice: Subject to any disclaimer, the term of this patent is extended or adjusted under 35 U.S.C. 154(b) by 158 days.

(21) Appl. No.: 10/523,202

(22) PCT Filed: Jun. 27, 2003

(86) PCT No.: PCT/GB03/02760

§ 371 (c)(1),
(2), (4) Date: Jan. 27, 2005

(87) PCT Pub. No.: WO2004/013438

PCT Pub. Date: Feb. 12, 2004

(65) Prior Publication Data

US 2005/0262664 A1 Dec. 1, 2005

(30) Foreign Application Priority Data

Aug. 1, 2002 (GB) ..... 0217908.3

(51) Int. Cl.
*E05D 3/06* (2006.01)

(52) U.S. Cl. ..... 16/366; 16/257; 16/262

(58) Field of Classification Search ..... 16/366, 16/368, 370, 257, 258, 261–263, 343–344; 49/345, 346, 339, 245–246, 252, 248; 403/288, 403/361, 326; 411/522, 539, 540
See application file for complete search history.

(56) References Cited

U.S. PATENT DOCUMENTS 1,119,412 A * 12/1914 Donegan et al. ..... 296/121
1,726,512 A * 8/1929 Hoover ..... 70/101
1,992,708 A * 2/1935 Mammen ..... 403/95
2,588,271 A * 3/1952 Morgan et al. ..... 16/261
2,932,861 A * 4/1960 Kunkel ..... 49/183
3,013,297 A * 12/1961 Chamberlain ..... 16/381
3,984,191 A * 10/1976 Doty ..... 403/69
4,080,758 A * 3/1978 Hubbard ..... 49/390
4,137,603 A * 2/1979 Kvasnes ..... 16/381

(Continued)

FOREIGN PATENT DOCUMENTS

CA 2230781 A * 8/1999

(Continued)

*Primary Examiner*—Chuck Y. Mah
(74) *Attorney, Agent, or Firm*—Allen, Dyer, Doppelt, Milbrath & Gilchrist, P.A.

(57) ABSTRACT

The invention provides a restricting device for a closure including a vent hingedly connected to a frame, the restricting device comprising a plate (1,4) for mounting on a frame, an arm (7) for pivotally mounting on a vent and means for releasably interengaging the arm and the plate, wherein, in use, when the plate and the arm are interengaged, the closure can only be opened a predetermined distance. The means for releasably interengaging the arm and the plate comprise a resilient means (2) adapted to engage a locking pin (5). The engagement between the arm and the plate is released by means of a release means, for example a key (6,6';6"), which is separate from the rest of the device. A preferred embodiment of the invention provides means (16,17; 18, 20) for preventing over-rotation of the key beyond a position in which the resilient means is in an optimum release position. The device is simple to use and has the advantage that it is detachable.

11 Claims, 5 Drawing Sheets

U.S. PATENT DOCUMENTS

| | | | | | |
|---|---|---|---|---|---|
| 4,428,154 | A | | 1/1984 | Rinehart | |
| 4,571,776 | A | * | 2/1986 | Taylor | 16/339 |
| 4,697,948 | A | * | 10/1987 | Fukuda | 403/71 |
| 6,442,899 | B1 | * | 9/2002 | Gledhill | 49/252 |
| 6,880,792 | B2 | * | 4/2005 | Muir | 248/276.1 |

FOREIGN PATENT DOCUMENTS

| | | | | |
|---|---|---|---|---|
| DE | 3320824 | A | * | 12/1984 |
| DE | 3627043 | C | * | 10/1987 |
| DE | 19623403 | C1 | * | 8/1997 |
| DE | 10306378 | A1 | * | 9/2003 |
| EP | 770751 | A | * | 5/1997 |
| EP | 1004733 | | | 5/2000 |
| EP | 1555367 | A2 | * | 7/2005 |
| EP | 1612354 | A2 | * | 1/2006 |
| FR | 2072702 | | | 9/1971 |
| FR | 2370845 | | | 6/1978 |
| JP | 2001214654 | A | * | 8/2001 |
| WO | WO9118170 | A | * | 11/1991 |

* cited by examiner

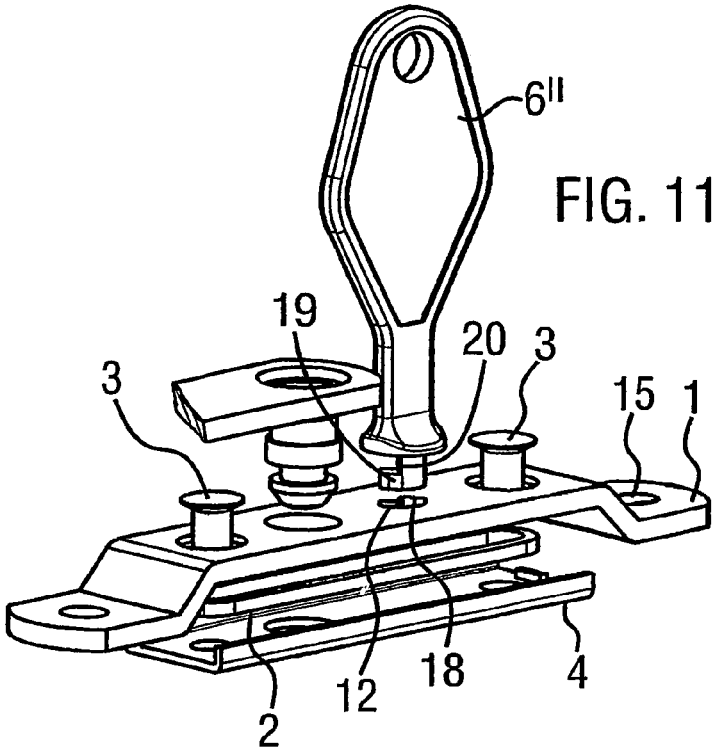
FIG. 11
FIG. 12A
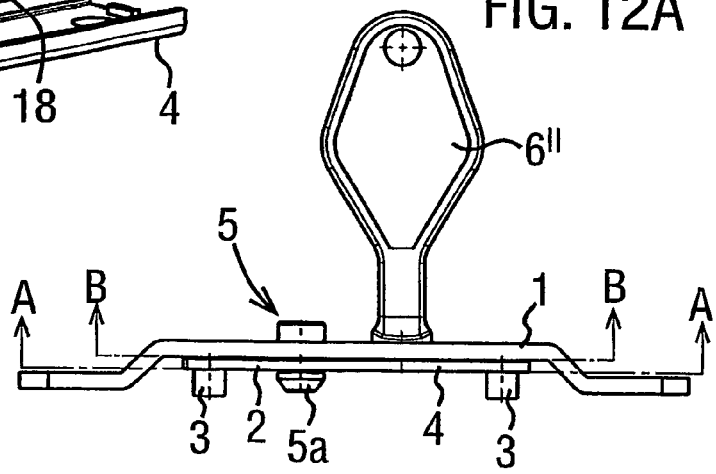
FIG. 12B
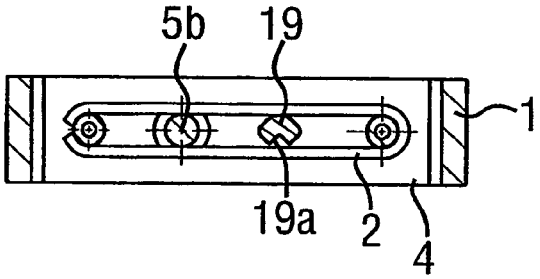
FIG. 12C
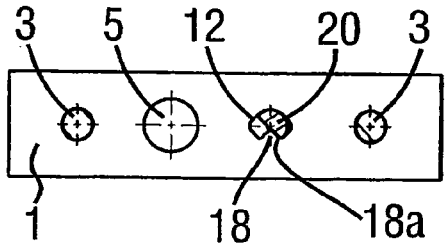
FIG. 12D
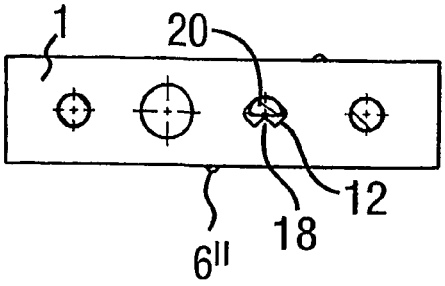
FIG. 12E
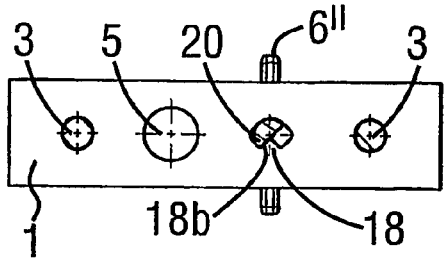

RESTRICTING DEVICE

FIELD OF THE INVENTION

The present invention relates to restricting devices, and in particular to releasable restricting devices that limit the opening and closing of a vent.

BACKGROUND OF THE INVENTION

Windows often include a vent connected to a frame by a hinge. This arrangement enables the window to be opened widely. However, it is often desirable to be able to restrict the extent to which this type of window can be opened during normal use for reasons of safety and security. Any device for restricting the opening of a window during normal use must also allow the window to be opened fully when required, for example for cleaning or in the case of a fire.

Although a number of restricting devices have been suggested in the prior art, many of such devices are complicated to manufacture and difficult to use. In particular, many of the prior art restricting devices have to be incorporated when a vent is manufactured or hung, and cannot be added to restrict the movement of a vent that is already in place.

SUMMARY OF THE INVENTION

The present invention aims to provide a restricting device that is simple and easy to operate. The restricting device provided by the present invention is also detachable and can therefore be added to restrict the movement of vents that have already been hung.

The invention provides a restricting device for a closure including a vent hingedly connected to a frame, the restricting device being adapted to act between the vent and the frame and comprising a plate, an arm and means for releasably interengaging the arm and the plate, wherein, in use, when the plate and the arm are interengaged, the closure can only be opened a predetermined distance, the means for releasably interengaging the arm and the plate comprising a resilient means adapted to engage a locking pin, engagement between the arm and the plate being released by releasing the resilient means, the means for releasing the resilient means being separate from the rest of the device.

The resilient means may be mounted on the arm and adapted to engage a locking pin mounted on the plate. Alternatively, and more preferably, the resilient means is mounted on the plate and adapted to engage a locking pin mounted on the arm.

Preferably, the locking pin comprises a tapered head of increasing diameter leading to a neck portion of reduced diameter. Preferably, engagement between the locking pin and the resilient means occurs by forcing the tapered head of increasing diameter past the resilient means such that the resilient means engages with the neck portion of the locking pin, thereby securing the locking pin and hence the arm in place.

Preferably, the resilient means comprises a resilient strip, preferably a metal strip, having one or two legs. Preferably, the resilient means comprises a resilient strip having two legs such that engagement between the locking pin and the resilient means occurs by forcing the tapered head of increasing diameter between the two legs of the resilient strip so that the resilient strip engages with the neck portion of the locking pin.

Preferably, the restricting device further comprises means for mounting the resilient means on either the plate or the arm. Where the resilient means comprises a resilient strip having two legs, the means for mounting the strip of metal preferably comprises rivets which are adapted to hold the two legs of the strip in an operative position to allow engagement with the locking pin to occur. The means for mounting the resilient strip may further comprise a support plate to hold the resilient strip in place.

Where the resilient means is a resilient strip having two legs, the means for releasing the resilient means is preferably a key that can be used to force the legs of the resilient strip apart such that the locking pin can be released. Where the locking pin comprises a tapered head of increasing diameter leading to a neck portion of reduced diameter, the key can preferably be used to force the legs of the resilient strip apart such that the major diameter of the tapered head of the locking pin can pass between them. Preferably, the key is adapted to be able to pass between the two legs of the resilient strip when it is engaged with the neck portion of the locking pin but to force the two legs of the resilient strip apart when the key is rotated. Preferably, the key has an eccentric cross-section, more preferably the cross-section has a major axis that is substantially perpendicular to a minor axis. Most preferably, the key has a diamond-shaped cross-section.

Preferably, the device further comprises key rotation stop means which prevents rotation of the key beyond a position in which the two legs of the resilient strip are forced apart to a maximum extent. This prevents the key from being over-rotated beyond a position in which the locking pin is releasable from the resilient strip. Even more preferably, the key rotation stop means comprises a specially shaped portion of the key and a correspondingly specially shaped hole in the plate. Preferably, the specially shaped portion of the key is semi-circular in cross-section, and the specially shaped hole in the plate includes a v-shaped notch, whereby the key is able to be turned through 90° between a position in which the specially shaped portion of the key abuts a first edge of the v-shaped notch, and a position in which the specially shaped portion of the key abuts a second edge of the v-shaped notch.

The plate of the restricting device may be mounted on a vent with the arm of the restricting device being mounted on a frame. Alternatively, and preferably, the plate of the restricting device is mounted on a frame and the arm of the restricting device is mounted on a vent. Preferably, the arm of the restricting device is pivotally mounted on either of one of a frame or a vent. Preferably, the arm of the restricting device is pivotally mounted on a track mounted on one of either a frame or a vent. Preferably, the track is a C-section track. More preferably, the arm is pivotally mounted on a slider, possibly a friction slider, that is mounted in the track and adapted to slide along the track. The track preferably comprises stops to limit the extent to which the slider can slide along the track and to prevent the slider from sliding off either end of the track.

The restricting device of the invention may be adapted for use on any closure including doors and windows. Preferably, the restricting device is adapted for use on a window. The plate of a restricting device of the invention may include screw-boles to facilitate mounting the plate on a frame or a vent of the closure. Where the restricting device comprises a track, the track may also include screw-holes to facilitate attaching the track on a vent or a frame of the closure.

Other preferred features of the restricting device described above will become apparent from the description with reference to the drawings which follows herein.

BRIEF DESCRIPTION OF THE DRAWINGS

The present invention is now described by way of example with reference to the accompanying drawings, in which:

FIG. 11 corresponds with both FIGS. 1 and 9, but shows another alternative embodiment of the restricting device, in accordance with the present invention;

FIG. 12A is a side view of part of the restricting device of FIG. 11;

FIG. 12B is a view on section A-A of FIG. 12A; and

FIGS. 12C to 12E are views on section B-B of FIG. 12A, detailing the rotation of a key of the restricting device of FIG. 11.

DETAILED DESCRIPTION OF THE INVENTION

Figure 1:
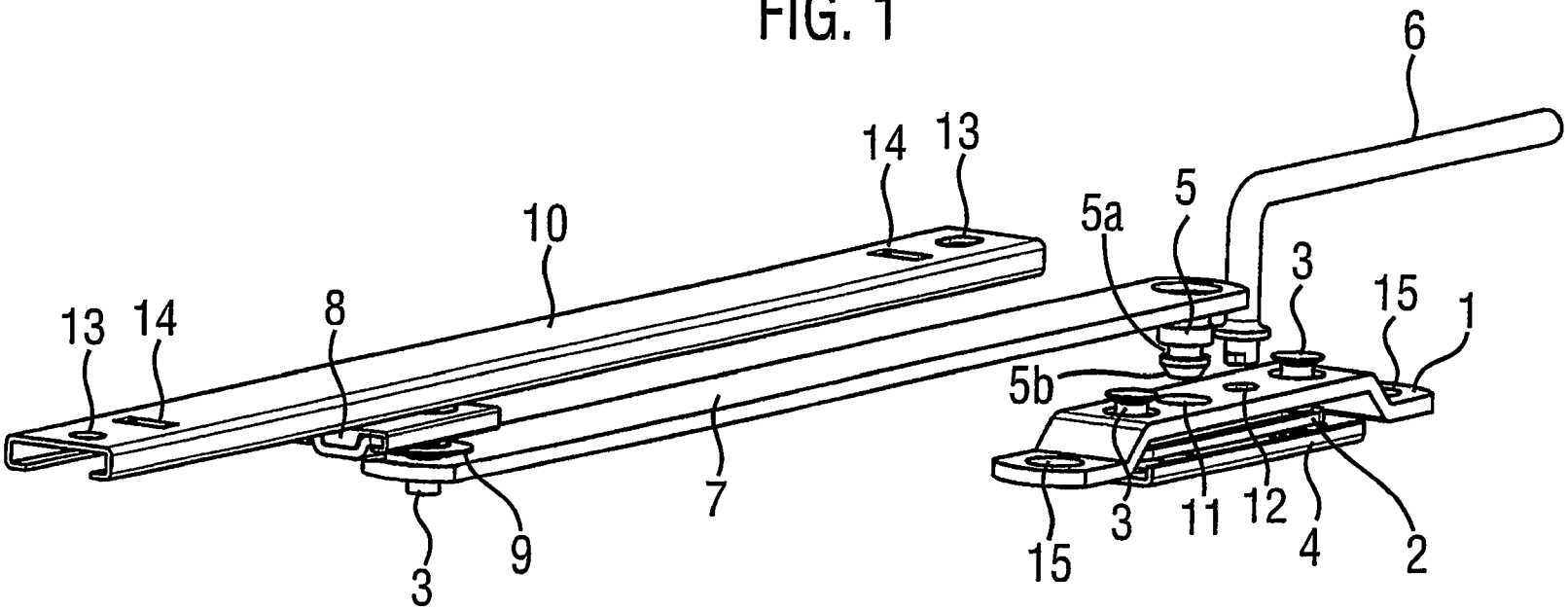
FIG. 1 is an exploded isometric assembly drawing of an embodiment of a restricting device according to this present invention.

Referring to FIG. 1, a restricting device comprises a joggled link (or mounting plate) 1 for attachment to a frame (not shown), a C-section track 10 for attachment to a vent (not shown), a slider 8, a pivot arm 7, a locking pin 5, a spring 2, and a key 6.

The joggled link includes screw-holes 15 to facilitate the attachment of the joggled link to the frame. The spring 2 is located beneath the joggled link 1 and above a support plate 4. The spring comprises a resilient strip of metal having two legs. Rivets 3 hold the joggled link 1, spring 2 and support plate 4 together. The rivets 3 also hold the two legs of the resilient strip of metal in an operative position to enable engagement with a locking pin on the arm to occur.

The track 10 includes screw-holes 13 to facilitate attachment of the track to a vent. A slider 8 is engaged with the track 10 such that it can slide along it. The track 10 also includes crack stops 14 which limit the extent to which the slider 8 can slide along the track 10 and prevent the slider 8 from sliding out of the ends of the track 10.

The pivot arm 7 is pivotally connected to the slider 8 by means of a rivet 3 and a washer 9. The other end of the pivot arm 7 comprises the locking pin 5 having a tapered head 5*b* of increasing diameter leading to a neck portion 5*a* of reduced diameter. The joggled link 1 has a pivot hole 11 for receiving the locking pin 5 when the pivot arm 7 is engaged with the joggled link 1 and a keyway 12 for receiving the key 6 to enable the pivot arm 7 to be released from the joggled link 1.

Figure 2:
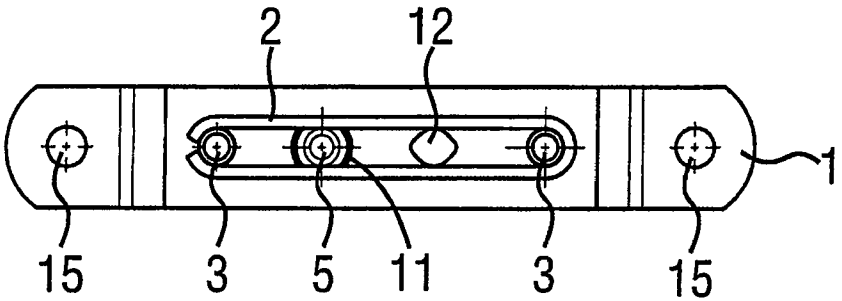
FIGS. 2 to 8 are 2D drawings detailing the engagement and release of a locking pin mounted on an arm by a resilient means mounted on a plate, according to the present invention.
Figure 3:
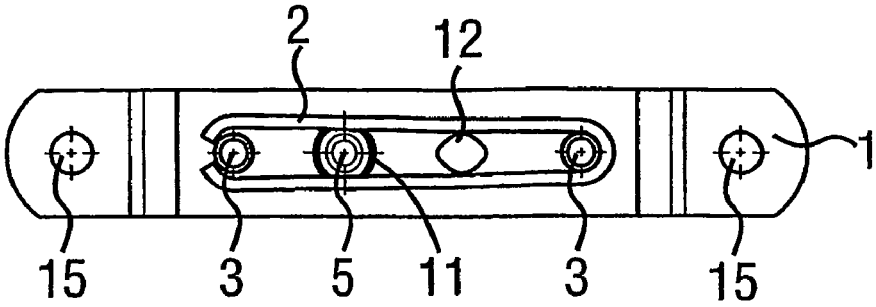
Figure 4:
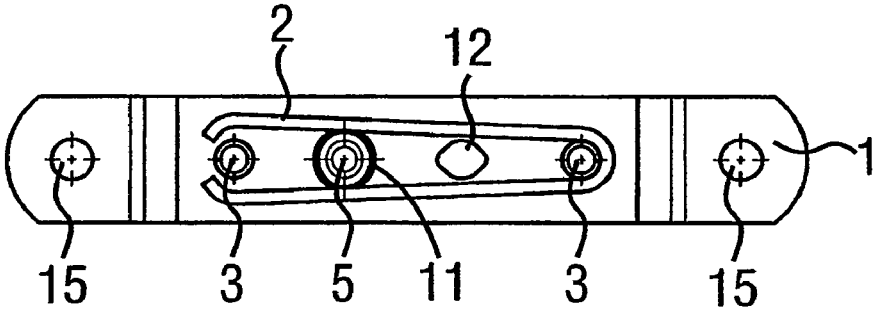
Figure 5:
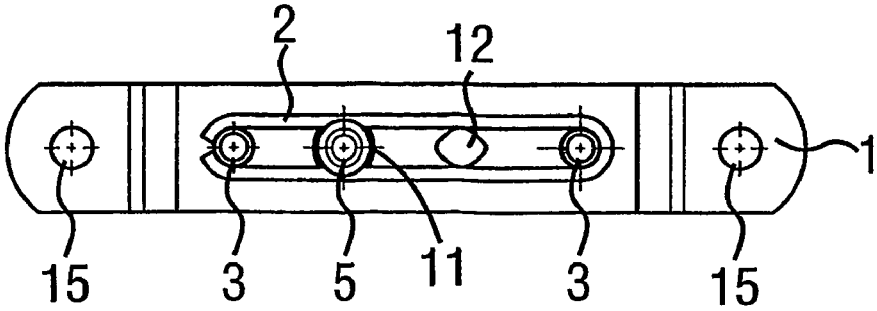

FIGS. 2 to 5 detail the engagement of the locking pin 5 of the pivot arm 7 with the joggled link 1. Referring to FIG. 2, the tapered head of the locking pin 5 is pushed through the pivot hole 11 of the joggled link 1. The tapered head of the locking pin 5 engages on the legs of the spring 2 below the joggled link forcing them apart, as shown in FIG. 3. Eventually, as shown in FIG. 4, the legs of the spring 2 are forced far enough apart to enable the major diameter of the tapered bead of the locking pin 5 to pass between them. Once the major diameter of the locking pin 5 has passed between the legs of the spring 2, the legs of the spring 2 flex back into the reduced diameter of the neck portion of the locking pin 5, securing it in place, as shown in FIG. 5. If the locking pin 5 is engaged with the joggled link in this way when the vent is closed, the vent can only be partially opened. The vent can only be opened as far as is allowed by the sliding of the slider 8 along the track 10 mounted on the vent.

Figure 6:
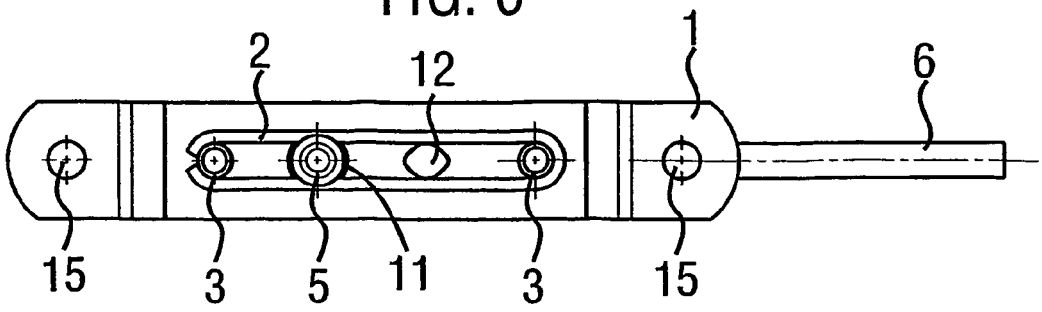
Figure 7:
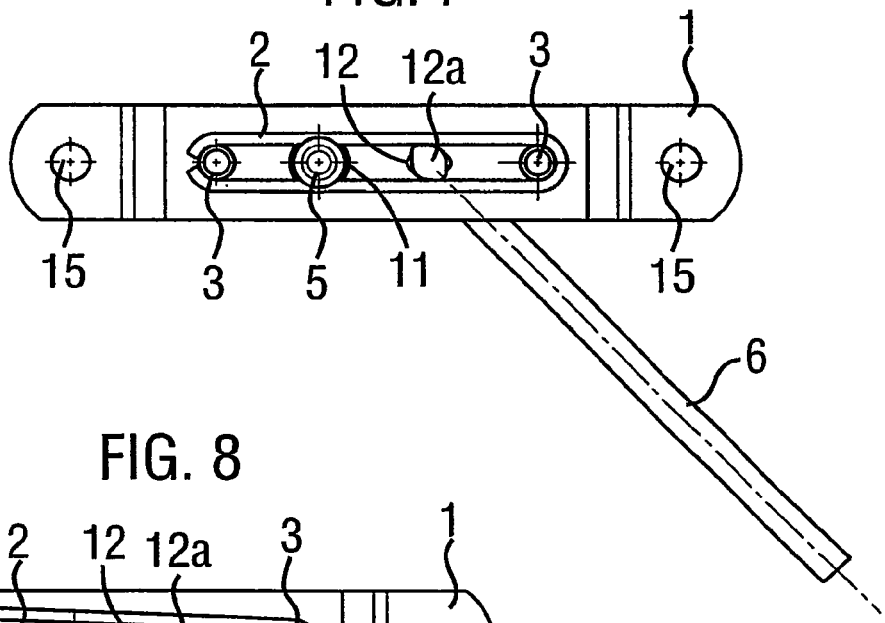
Figure 8:
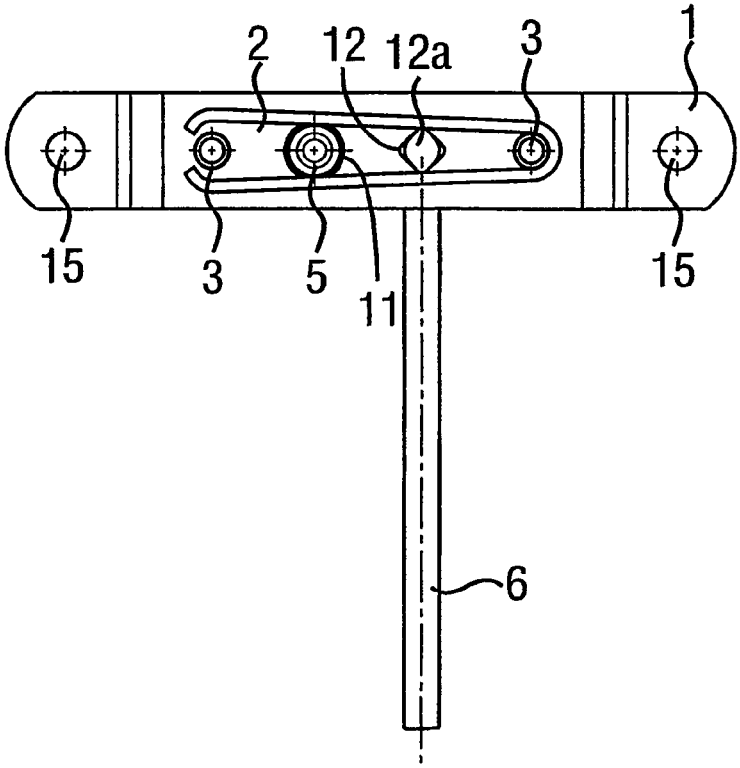

FIGS. 6 to 8 detail the release of the pivot arm 7 from the spring 2. Release of the pivot arm is achieved by using a key 6 which is inserted into a keyway 12 in the joggled link, as shown in FIG. 6. The key 6 has a diamond-shaped cross-section 12*a* with one diameter of the diamond being sufficiently small to enable the key to pass between the legs of the spring 2 when it is engaged with the neck portion of the locking pin 5. As the key is rotated, the larger second diameter of the diamond cross-section engages with the legs of the spring 2 (FIG. 7) eventually flexing them apart enough to enable the major diameter of the tapered head of the locking pin 5 to pass between them, as shown in FIG. 8. The locking pin 5 can then be removed from the spring 2 through the pivot hole 11 in the joggled link 1. As the movement of the pivot arm 7 is no longer restricted by engagement with the spring 2 attached to the joggled link 1, the movement of the vent is not restricted and it can open freely. It will be appreciated that the cross-section of the key does not have to be diamond-shaped. A key with any suitable cross-section may be used provided that it is able to pass between the legs of the spring when the spring is engaged with the neck of the locking pin, and that, on rotation, it is able to engage with the legs of the spring, forcing them apart to enable the major diameter of the tapered head of the locking pin to pass between them such that the locking pin can be removed.

Figure 9:
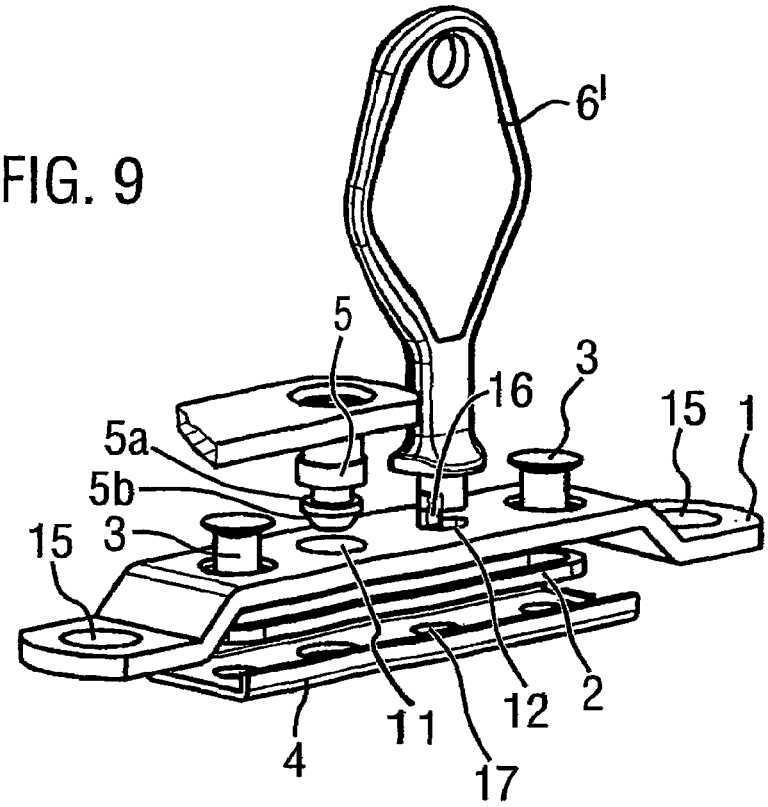
FIG. 9 corresponds with FIG. 1, but shows an alternative embodiment of the restricting device, in accordance with the present invention.
Figure 10A:
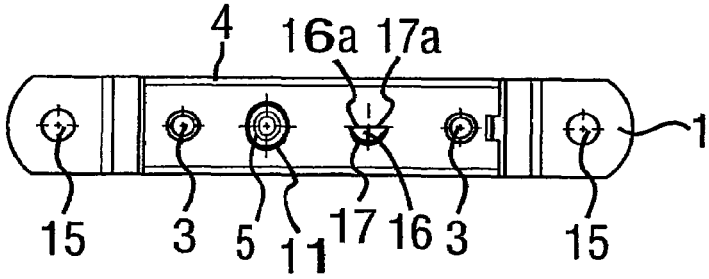
FIGS. 10A to 10C are plan views from below, detailing the rotation of a key of the restricting device of FIG. 9.
Figure 10B:
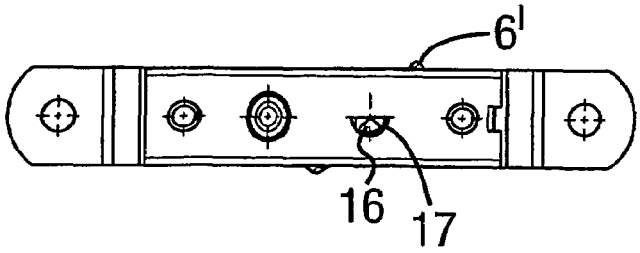
Figure 10C:
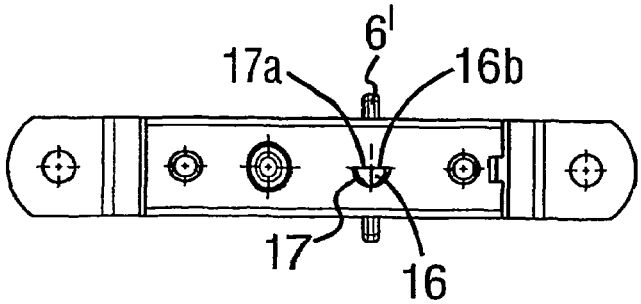

In FIG. 9, there is illustrated an alternative key 6'. The key 6' has the same diamond-shaped cross-section as key 6. However, at the distal end of the key 6' there is an additional raised portion 16. As best seen in FIGS. 10A to 10C, the additional raised portion 16 has a quadrant-shaped cross-section. In this embodiment, the support plate 4 includes a semi-circular hole 17 in alignment with the keyway 12 in the joggled link 1.

When the key 6' is inserted in the keyway 12, the raised portion 16 is located so that a first radial edge 16*a* is adjacent the diametrical edge 17*a* of the hole 17. This prevents the key 6' being turned in a clockwise direction (when viewed from below, as in FIGS. 10A to 10C). Thus the key 6' may only be turned in an anti-clockwise direction. FIG. 10B shows the key 6' partially rotated. As shown in FIG. 10C, once the key 6' has been rotated through 90° the second radial edge 16*b* of the raised portion 16 abuts the edge 17*a* of the semi-circular hole 17. Thus any further anti-clockwise rotation is prevented.

This position corresponds to that of FIG. 8, whereby legs of the spring 2 are flexed apart to a maximum extent by the diamond-shaped cross-section of the key. Thus, the raised portion 16 and the semi-circular hole 17 together comprise key rotation stop means which prevent over-rotation of the key 6' beyond the position of maximum flexion of the legs of the spring 2.

An alternative embodiment is illustrated in FIGS. 11 to 12E. In this embodiment, the key 6" has a distinct form, and the keyway 12 in the joggled link 1 is provided with a v-notch 18. As best shown in FIG. 12B, a distal portion 19 of the key 6" has a cross-section that corresponds to the shape of the keyway 12. In other words, the distal portion 19 has a diamond-shaped cross-section with a v-groove 19*a*. When inserted into the restricting device, the distal portion 19 of the key 6" must be oriented so that the v-groove 19*a* is in alignment with the v-notch 18. As best shown in FIGS. 12C to 12E, a proximal portion 20 of the key 6" has a semi-circular cross-section. When fully inserted, the distal portion 19 is located adjacent the spring 2, for co-operation therewith, and the proximal portion 20 is located within the keyway 12.

The proximal portion 20 is oriented relative to the distal portion 19 such that when first inserted into the device (FIG. 12C), the diametrical edge of the proximal portion is adjacent a first edge 18*a* of the v-notch 18. This prevents the key 6" being turned in a clockwise direction (when viewed from below, as in FIGS. 12C to 12E). Much as for the embodiment of FIGS. 9 to 10C, the key 6" is able to be rotated in an anti-clockwise direction through 90°. At this point (see FIG. 12E), the diametrical edge of the proximal portion 20 abuts a second edge 18*b* of the v-notch, thus preventing any further rotation.

The specially shaped keyway 12 with the v-notch 18, and the key 6" with the proximal 20 and distal 19 portions together comprise a key rotation stop. This functions in substantially the same manner as that described with respect to FIGS. 9 to 10C.

It will of course be understood that the present invention has been described above purely by way of example, and that modifications of detail can be made within the scope of the invention.

The invention claimed is:

1. A restricting device for a closure including a vent hingedly connected to a frame, the restricting device being adapted to act between the vent and the frame, and comprising a mounting plate, a support plate having an aperture therethrough, an arm, and means for releasably interengaging the arm and the mounting plate, wherein, in use, when the mounting plate and the arm are interengaged, the closure can only be opened a predetermined distance, the means for releasably interengaging the arm and the mounting plate comprising:

a resilient strip having two legs positioned between the mounting plate and the support plate; and a locking pin connected at a first end to the arm and comprising a head at a second end opposed to the first end and a neck between the first and the second ends having a diameter less than a diameter of the head, the head and neck dimensioned to permit a snap fit between the resilient strip legs, the mounting plate having an aperture for admitting a key having an eccentric head therethrough and a protrusion extending from a distal end thereof, the key head having a first and a second cross-sectional dimension, the second cross-sectional dimension greater than the first cross-sectional dimension and greater than a separation between the legs, the mounting plate aperture positioned and dimensioned for admitting the key head between the legs with the key head having the first cross-sectional dimension aligned with the legs, a turning of the key operative to force the legs apart to a sufficient width to release the locking pin from engagement with the resilient strip, the key head protrusion extending into the support plate aperture, the support plate aperture comprising a feature for preventing the key head protrusion, and thereby the key, to turn beyond a predetermined angle.

2. The restricting device recited in claim 1, wherein the resilient strip is mounted on the mounting plate and the locking pin is mounted on the arm.

3. The restricting device recited in claim 1, wherein the resilient strip comprises a resilient metal strip.

4. The restricting device recited in claim 1, wherein the key protrusion has a semi-circular cross section, and the support plate aperture includes a V-shaped notch, the key rotatable through approximately 90° between a first position in which the key protrusion abuts a first edge of the notch and second position in which key protrusion abuts a second edge of the notch.

5. The restricting device recited in claim 1, wherein the arm is pivotally mountable on a track.

6. The restricting device recited in claim 5, wherein the track comprises a C-section track.

7. The restricting device recited in claim 5, wherein the arm is pivotally mountable on a slider that is mounted in the track.

8. The restricting device recited in claim 7, wherein the slider comprises a friction slider.

9. The restricting device recited in claim 5, wherein the arm is pivotally mountable on a track comprising stops.

10. A closable aperture comprising one of a window and a door comprising a frame, a vent hingedly connected to the frame, and a restricting device adapted to act between the vent and the frame, the restricting device comprising a mounting plate, a support plate having an aperture therethrough, an arm, and means for releasably interengaging the arm and the mounting plate, wherein, in use, when the mounting plate and the arm are interengaged, the closure can only be opened a predetermined distance, the means for releasably interengaging the arm and the mounting plate comprising:

a resilient strip having two legs positioned between the mounting plate and the support plate; and a locking pin connected at a first end to the arm and comprising a head at a second end opposed to the first end and a neck between the first and the second ends having a diameter less than a diameter of the head, the head and neck dimensioned to permit a snap fit between the resilient strip legs, the mounting plate having an aperture for admitting a key having an eccentric head therethrough and a protrusion extending from a distal end thereof, the key head having a first and a second cross-sectional dimension, the second cross-sectional dimension greater than the first cross-sectional dimension and greater than a separation between the legs, the mounting plate aperture positioned and dimensioned for admitting the key head between the legs with the key head having the first cross-sectional dimension aligned with the legs, a turning of the key operative to force the legs apart to a sufficient width to release the locking pin from engagement with the resilient strip, the key head protrusion extending into the support plate aperture, the support plate aperture comprising a feature for preventing the key head protrusion, and thereby the key, to turn beyond a predetermined angle.

11. A restricting system for a closure including a vent hingedly connected to a frame, the restricting device being adapted to act between the vent and the frame, and comprising a mounting plate, a support plate having an aperture therethough, an arm, and means for releasably interengaging the arm and the mounting plate, wherein, in use, when the mounting plate and the arm are interengaged, the closure can only be opened a predetermined distance, the means for releasably interengaging the arm and the mounting plate comprising:

a resilient strip having two legs positioned between the mounting plate and the support plate;

a key having an eccentric head and a protrusion extending from a distal end thereof, the key head having a first and a second cross-sectional dimension, the second cross-sectional dimension greater than the first cross-sectional dimension and greater than a separation between the legs; and a locking pin connected at a first end to the arm and comprising a head at a second end opposed to the first end and a neck between the first and the second ends having a diameter less then a diameter of the head, the head and neck dimensioned to permit a snap fit between the resilient strip legs, the mounting plate having an aperture positioned and dimensioned for admitting the key head between the legs with the key head having the first cross-sectional dimension aligned with the legs, a turning of the key operative to force the legs apart to a sufficient width to release the locking pin from engagement with the resilient strip, the key head protrusion extending into the support plate aperture, the support plate aperture comprising a feature for preventing the key head protrusion, and thereby the key, to turn beyond a predetermined angle.

* * * * *